US006230811B1

(12) United States Patent
Ringgenberg et al.

(10) Patent No.: US 6,230,811 B1
(45) Date of Patent: May 15, 2001

(54) INTERNAL PRESSURE OPERATED CIRCULATING VALVE WITH ANNULUS PRESSURE OPERATED SAFETY MANDREL

(75) Inventors: Paul D. Ringgenberg, Carrollton, TX (US); Michael Norman, Melbourne, FL (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/238,266

(22) Filed: Jan. 27, 1999

(51) Int. Cl.[7] ..... E21B 34/06; E21B 34/10

(52) U.S. Cl. ..... 166/374; 166/386; 166/320; 166/332.1

(58) Field of Search ..... 166/386, 374, 166/320, 321, 332.1, 334.1, 334.4; 137/628

(56) References Cited

U.S. PATENT DOCUMENTS 4,429,747 * 2/1984 Williamson, Jr. ..... 166/321
4,474,242 * 10/1984 Upchurch ..... 166/323
4,657,083 * 4/1987 Ringgenberg ..... 166/323
4,724,908 * 2/1988 Pringle ..... 166/317
4,944,349 * 7/1990 Von gonten, Jr. ..... 166/304
5,127,476 * 7/1992 Dickson et al. ..... 166/323
5,355,959 * 10/1994 Walter et al. ..... 166/321
5,558,162 * 9/1996 Manke et al. ..... 166/319

* cited by examiner

*Primary Examiner*—Eileen D. Lillis
*Assistant Examiner*—John Kreck
(74) *Attorney, Agent, or Firm*—Paul I. Herman; Lawrence R. Youst

(57) ABSTRACT

A downhole tool (100) for selectively providing fluid communication between the interior and the exterior of the tool (100). The tool (100) comprises a housing (102), a safety mandrel (130) slidably received within the housing (102) and an operating mandrel (114) slidably received within the housing (102). The safety mandrel (130) operates between a first position and a second position relative to the housing (102) in response to pressure being applied to the exterior of the housing (102). The operating mandrel (114) operates from a noncirculating position to a circulating position in response to pressure being applied to the interior of the housing (102) once the safety mandrel (130) has operated to its second position.

20 Claims, 3 Drawing Sheets

INTERNAL PRESSURE OPERATED CIRCULATING VALVE WITH ANNULUS PRESSURE OPERATED SAFETY MANDREL

TECHNICAL FIELD OF THE INVENTION

This invention relates, in general, to an apparatus and method used during formation testing and, in particular to, an internal pressure operated circulating valve that is placed in the operating position only if sufficient annular hydrostatic pressure unlocks a safety mandrel.

BACKGROUND OF THE INVENTION

Without limiting the scope of the present invention, its background is described in connection with performing tests to determine the production capabilities of a formation traversed by a wellbore, as an example.

During the course of drilling an oil or gas well, the wellbore is typically filled with a fluid known as drilling fluid or drilling mud. One of the purposes of this drilling fluid is to contain formation fluids within the formation intersected by the wellbore. To contain these formation fluids, the drilling mud is weighted with various additives so that the hydrostatic pressure of the drilling mud at the formation depth is sufficient to maintain the formation fluid within the formation without allowing it to escape into the wellbore.

When it is desired to test the production capabilities of the formation, a test string is lowered into the wellbore to the formation depth and the formation fluid is allowed to flow into the test string in a controlled testing program. Lower pressure is maintained in the interior of the test string as it is lowered into the wellbore. This is usually done by keeping a valve in the closed position near the lower end of the test string. When the testing depth is reached, a packer is set to seal the wellbore thus closing in the formation from the hydrostatic pressure of the drilling fluid in the well annulus. The valve at the lower end of the test string is then opened and the formation fluid, free from the restraining pressure of the drilling fluid, can flow into the interior of the test string.

The testing program typically includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is typically opened so that formation fluid in the test string may be circulated out. Since the hydrostatic pressure of the drilling fluid near the formation is generally much higher than the formation fluids in the test string, it is usually only necessary that the annulus be placed in fluid communication with the interior of the test string to start to reverse out the formation fluids from the test string. Following this circulation step, the packer may be released so that the test string may be withdrawn from the wellbore.

Typically, the circulating valves used in a test string may include a sliding sleeve that is opened in response to pressure in the annulus. It has been found, however, that when it is desirable to have more than one circulating valves in a test string to be operated at different times, each tool must be set to operate at a different pressure. Since 500 psi typically separates the pressures at which respective circulating valves will operate, extremely high pressures would be required to operate the later circulating valves in such a configuration, which may damage the well casing.

To overcome this problem, attempts have been made to utilize internal pressure operated circulating valves that operated in response to pressure in the test string. It has been found, however, that internal pressure operated circulation valves may be inadvertently opened as the result of an increase in the pressure within the test string. For example, when the test string is made up and lowered into the wellbore, it is desirable to periodically pressure test the test string to assure that the pipe joints have been adequately made up. Such testing requires closing of a valve in the lower part of the test string and applying pump pressure to the interior or the test string at the surface of the well. If the test string includes an interior pressure operated circulation valve, it may be inadvertently opened during such a test string pressure test.

It has also been found that internal pressure operated circulation valves may be inadvertently opened as the result of an unexpected increase in pressure from a formation that is not properly under control. If an internal pressure operated circulation valve is not operated during a testing program and is pulled out of the hole in the unoperated position, such a pressure upset from the formation could open an internal pressure operated circulation valve and allow formation fluids to be release at the surface.

Therefore, a need has arisen for an internal pressure operated circulation valve that will not inadvertently opened as the result of an increase in the pressure within the test string during a pressure test of the test string. A need has also arisen for such an internal pressure operated circulation valve that will not inadvertently open as a result of an unexpected pressure surge from the formation particularly when the internal pressure operated circulating valve is at or near the surface.

SUMMARY OF THE INVENTION

The present invention disclosed herein comprises an internal pressure operated circulation valve that will not inadvertently open as the result of an increase in the pressure within the test string during a surface pressure test of the test string. Likewise, the integral pressure operated circulation valve of the present inception will not inadvertently opened as a result of an uninspected pressure surge from the formation.

The internal pressure operated circulation valve of the present invention comprises a housing, a safety mandrel and an operating mandrel. The safety mandrel is slidably received within the housing. The safety mandrel operates from a first position to a send position relative to the housing in response to pressure being applied to the exterior of the housing. The operating mandrel is also slidably received within the housing. The operating mandrel operates from a noncirculating position to the circulation position in response to pressure being applied to the interior of the housing. The operating mandrel, however, will only operate to the circulating position when the safety mandrel has operated to the second position. When the operating mandrel is in the circulating position, fluid flow through a circulating port formed through a wall of the housing is permitted.

A portion of the safety mandrel is slidably received within the operating mandrel to selectively prevent the operation of the operating mandrel. In one embodiment, the safety mandrel physically preventing the movement of the operating mandrel in the second direction. In another embodiment, the safety mandrel prevents the operation of the operating mandrel by preventing the pressure applied to the interior of the housing from acting on the operating mandrel.

The internal pressure operated circulation valve of the present invention may include a biasing device, such as a coil spring, to urge the safety mandrel to its first position such that a predetermined pressure applied to the exterior of the housing is required to operate the safety mandrel to its second position. The internal pressure operated circulation valve of the present invention may also include a frangible restraining device, such as one or more sheer pins, to selectively prevent the movement of the operating mandrel such that a predetermined pressure applied to the interior of the housing is required to operate the operating mandrel to the circulating position.

In the method of the present invention, an operating mandrel disposed within a housing is operated by, disposing a safety mandrel in the housing for initially preventing the operation of the operating mandrel, applying pressure to the exterior of the housing to operate the safety mandrel between a first position and a second position relative to the housing and applying pressure to the interior of the housing to operate the operating mandrel from a nocirculating position to a circulating position, thereby permitting fluid flow through a circulating port formed through a wall in the housing.

In the method, the safety mandrel initially prevents the operation of the operating mandrel by disposing a portion of the safety mandrel within the operating mandrel. In one embodiment, this is achieved by physically preventing the movement of the operating mandrel in the second direction. In another embodiment, this is achieved by preventing the pressure applied to the interior of the housing from acting on the operating mandrel.

The method of the present inventon may require that a predetermined pressure be applied to the exterior of the housing to operate the safety mandrel to the second position by biasing the safety mandrel to the first position with a biasing device. Likewise, the method of the present invention may require that a predetermined pressure be applied to the interior of the housing to operate the safety mandrel to circulating position by frangibly restraining the operating mandrel.

BRIEF DESCRIPTION OF THE DRAWINGS

For a more complete understanding of the features and advantages of the present invention, references now made to the detailed description of the invention along with the accompanying figures in which corresponding numerals in the different figures refer to corresponding parts and in which.

DETAILED DESCRIPTION OF THE INVENTION

While the making and using of various embodiments of the present invention is discussed in detail below, it should be appreciated that the present invention provides many applicable inventive concepts which can be embodied in a wide variety of specific contexts. The specific embodiment discussed herein are merely illustrative of the specific ways to make and use the invention, and do not limit the scope of the invention.

Figure 1:
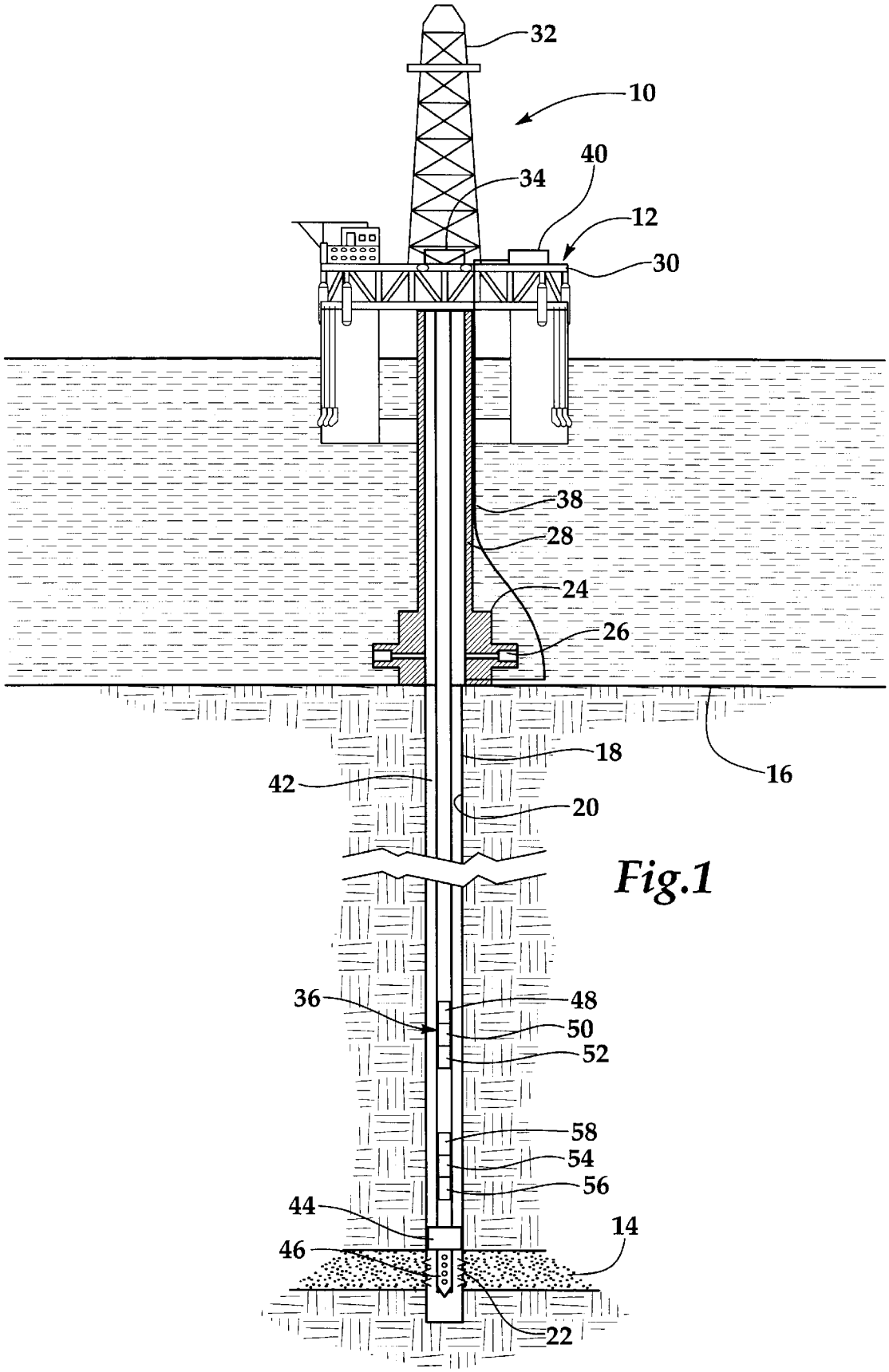
FIG. 1 is a schematic illustration of an offshore oil or gas drilling platform operating a test string including an internal pressure operate circulating valve of the present invention.

Referring to FIG. 1, an offshore drilling and testing operation is schematically illustrated and generally designated 10. A semi-submersible platform 12 is centered over a submerged oil or gas formation 14 located below the sea floor 16. A well comprising a wellbore 18 is lined with a casing string 20 extending from the platform 12 to formation 14. Casing string 20 includes a plurality of perforations 22 at its lower end which provide communication between formation 14 and the interior of the wellbore 18.

A wellhead installation 24 which includes blowout preventors 26 is located on sea floor 16. A conductor 28 extends from wellhead installation 24 to platform 12. Platform 12 includes a work deck 30 that supports a derrick 32. Derrick 32 supports a hoisting apparatus 34 for raising and lowering pipe strings such as formation testing string 36. A supply conduit 38 is provided that extends from a hydraulic pump 40 on deck 30 of platform 12 and extends to the wellhead installation 24 at a point below blowout preventors 26 to allow the pressurizing of the well annulus 42 surrounding test string 36.

During testing, a seal assembly 44 is used to isolate formation 14 from fluids in well annulus 42. A perforated tail piece 46 is provided at the lower end of test string 36 to allow fluid communication between formation 14 and the interior of test string 36. The lower portion of test string 36 also includes intermediate conduit portion 48 and torque transmitting pressure and volume balanced slip joint 50. An intermediate conduit portion 52 is provided for imparting setting weight to seal assembly 44. Near the lower end of test string 36 is located a tester valve 54 which may typically be an annulus pressure operated tester valve. A pressure recording device 56 is located below tester valve 54. Immediately above tester valve 54 is an internal pressure operated circulating valve 58 of the present invention.

Even though FIG. 1 depicts an offshore environment, it should be understood by one skilled in the art that the downhole component described herein is equally well-suited for operation in an onshore environment.

Figure 2A:
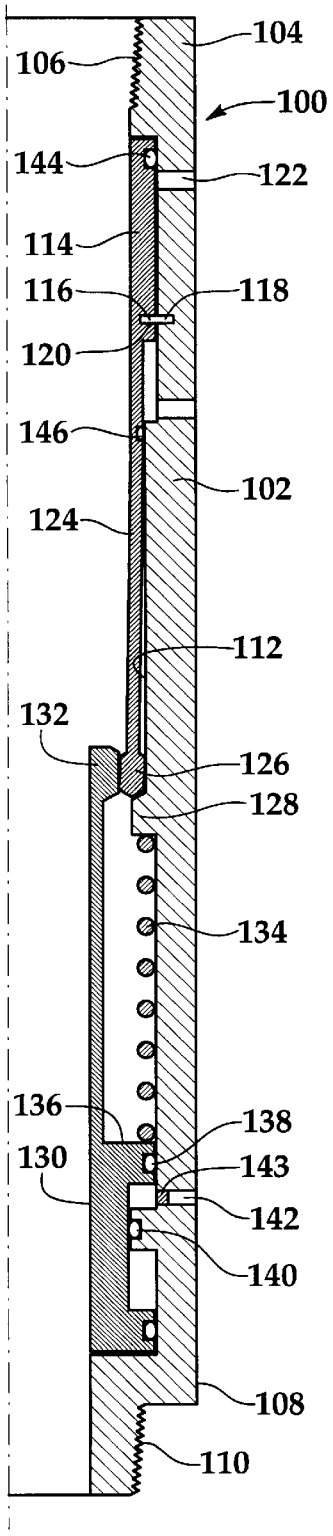
FIGS. 2A–2C are quarter sectional views of an internal pressure operated circulating valve of the present invention in its various operating positions.
Figure 2B:
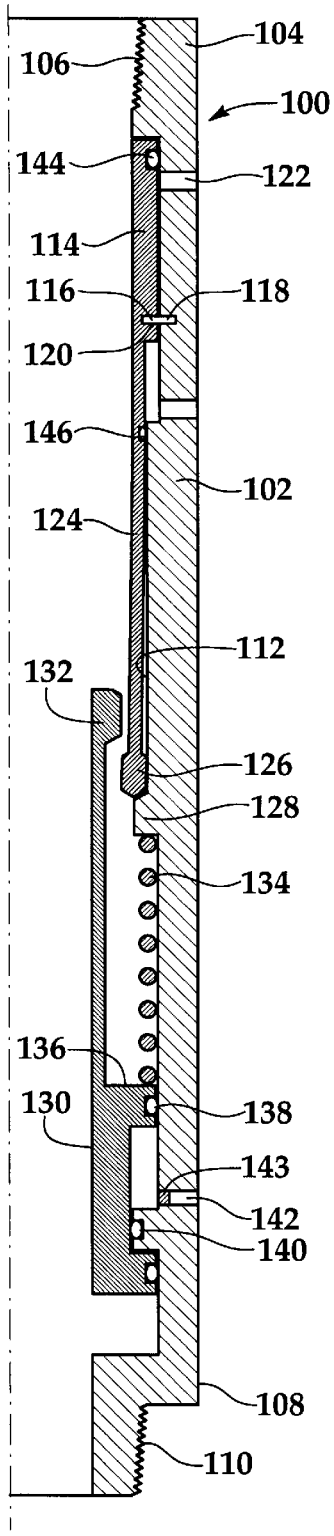
Figure 2C:
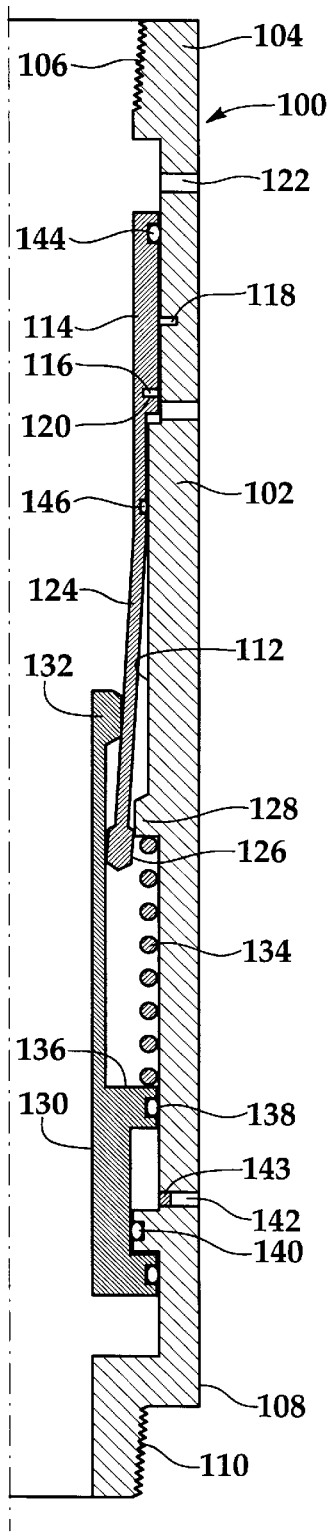

Referring now to FIGS. 2A–2C therein is depicted quarter sectional views of one embodiment of an internal pressure operated circulating valve of the present invention that is generally designated 100. Valve 100 includes a cylindrical outer housing 102 having an upper housing adapter 104 which includes threads 106 for attaching valve 100 to the portion of test string 36 located above valve 100. At the lower end of housing 102 is a lower housing adapter 108 which includes an external threaded portion 110 for connection of valve 100 to that portion of test string 36 located below valve 100.

Slidably and sealably received within inner bore 112 of housing 102 is operating mandrel 114. Operating mandrel 114 is initially frangibly retained in its noncirculating position by one or more shearable members such as a shear pin 116 which is disposed through a radial bore 118 of housing 102 and received within a radially extending bore 120 of operating mandrel 114. The exact number and size of the shearable members will be determined based upon the desired operating pressure for operating mandrel 114.

In the noncirculating position as depicted in FIG. 2A, operating mandrel 114 prevents the flow of fluids between the exterior of valve 100 and the interior of valve 100 through circulating port 122. Operating mandrel 114 includes a plurality of spring fingers, one of which is finger 124. Spring finger 124 is terminated by head 126. In the noncirculating position, head 126 rests against the upper shoulder of annular ledge 128 of housing 102.

Slidably and sealably received within inner bore 112 of housing 102 below operating mandrel 114 is safety mandrel 134. Safety mandrel 130 includes an upper end 132 that is closely received within head 126 of operating mandrel 114 to physically prevent the movement of operating mandrel 114.

A coil compression spring 134 has its upper end engaging the lower shoulder of annular ledge 128 and has its lower end engaging annular upper end surface 136 of safety mandrel 130. Spring 134 biases safety mandrel 130 downwardly to maintain upper end 132 against head 126 and prevent movement of operating mandrel 114. In this position of valve 100, internal pressure testing of testing string 36 may periodically occur without moving operating mandrel 114 or loading shearable members 116.

Spring 134 is initially retained in a substantially uncompressed state until external pressure applied to safety mandrel 130 through communication port 142 of housing 102 acts between seals 138 and 140. When the external hydrostatic pressure reaches a sufficient level, safety mandrel 130 travels upwardly relative to housing 102 compressing spring 134, as best seen in FIG. 2B. A rupture disk 143 may be placed within communication part 142 to selectively prevent the external hydrostatic pressure from communicating with safety mandrel 130 until the external hydrostatic pressure reaches a sufficient level to burst rupture disk 143. Once safety mandrel 130 has traveled upwardly, safety mandrel 130 no longer physically restrains the movement of operating mandrel 114. If the external hydrostatic pressure is reduced below the predetermined level, valve 100 is reset into the position depicted in FIG. 2A due to the bias force of spring 134. The procedure may be repeated without moving operating mandrel 114.

When valve 100 is in the position depicted in FIG. 2B, application of internal pressure then acts on operating mandrel 114 between seals 144 and 146 thus urging operating mandrel 114 downwardly. When sufficient pressure is applied, pin 116 shears thus permitting operating mandrel 114 to move downwardly. As operating mandrel 114 moves downwardly, the spring fingers, such as spring finger 124, are no longer restrained by upper end 132 of safety mandrel 130 and spring inwardly around annular ledge 128 of housing 102, as best seen in FIG. 2C.

It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that the downhole component described herein may be operated in vertical, horizontal, inverted or inclined orientation without deviating from the principles of the present invention.

In operation, valve 100 is initially assembled at the surface as shown in FIG. 2A. Thereafter, valve 100 is incorporated into a test string such as that shown in FIG. 1 and lowered into the wellbore as shown in FIG. 1. When in this configuration, tester valve 54 of FIG. 1 may be repeatedly opened and closed by application of annulus pressure in order to conduct pressure tests of test string 36 which may shift safety mandrel 130 but will not shift operating mandrel 114 of valve 100. Thereafter, fluids may be pumped through test string 36 and into formation 14, for example, for acid-treating formation 14. After testing and treatment, but prior to raising test string 36 out of wellbore 18, it is desirable to reverse circulate fluids from test string 36. Such is accomplished by moving the operating mandrel downwardly so that circulation port 122 is in communication with the interior of housing 102. Thereafter, fluid is pumped downwardly in the annulus through port 122 and upwardly through test string 36 thereby reverse circulating fluids from test string 36.

Valve 100 is opened by shifting safety mandrel 130 then shifting operating mandrel 114 as follows. With valve 100 in the configuration of FIG. 2A and suspended on test string 36 as shown in FIG. 1, the hydrostatic pressure of the annulus fluids upwardly bias safety mandrel 130 via communication port 142. Seal 138 defines an outer diameter and seal 140 an inner diameter of safety mandrel 130. When the hydrostatic force reaches the predetermined level necessary to overcome the bias force of spring 134, safety mandrel 130 moves upwardly with upper end 132 of safety mandrel 130 no loner contacting head 126 of spring finger 124 of operating mandrel 114. Alternatively, rupture disk 143 may be placed within communication port 142 which may be set to burst at a predetermined pressure.

After safety mandrel 130 has moved to its upper position as best seen in FIG. 2B, test string 36 is pressurized thus permitting pressurized fluid to act on operating mandrel 114. Seal 144 defines an outer diameter and seal 146 defines the inner diameter of operating mandrel 114. When the pressure reaches the predetermined level necessary to shear the shear pins 116, operating mandrel 114 moves quickly downwardly. In the lower position of operating mandrel 114, as best seen in FIG. 2C, seal 144 is below port 122 and thus fluid communication is permitted between the annulus and the interior of housing 102 thereby allowing reverse circulation.

Once operating mandrel 114 has opened circulating port 122, it remains open. When the formation fluids are circulated out of test string 36 and fully replaced by the fluids from the annulus, test string 36 may be pulled from the wellbore.

Thus, it can be seen that prior to the operation of safety mandrel 130, for example during a surface test string pressure test, there is no risk of inadvertently opening circulation port 122 since interior pressure will not operate operating mandrel 114. Before pressure in test string 36 can be so communicated, safety mandrel 130 must be urged upwardly until upper end 132 no longer interferes with the movement of operating mandrel 114. It should be noted that if interior pressure is not applied to operating mandrel 114 while safety mandrel 130 is in the uppermost position, spring 134 will return safety mandrel 130 to the position seen in FIG. 2A when the bias force of spring 134 becomes greater than the hydrostatic force acting upwardly on safety mandrel 130.

Figure 3A:
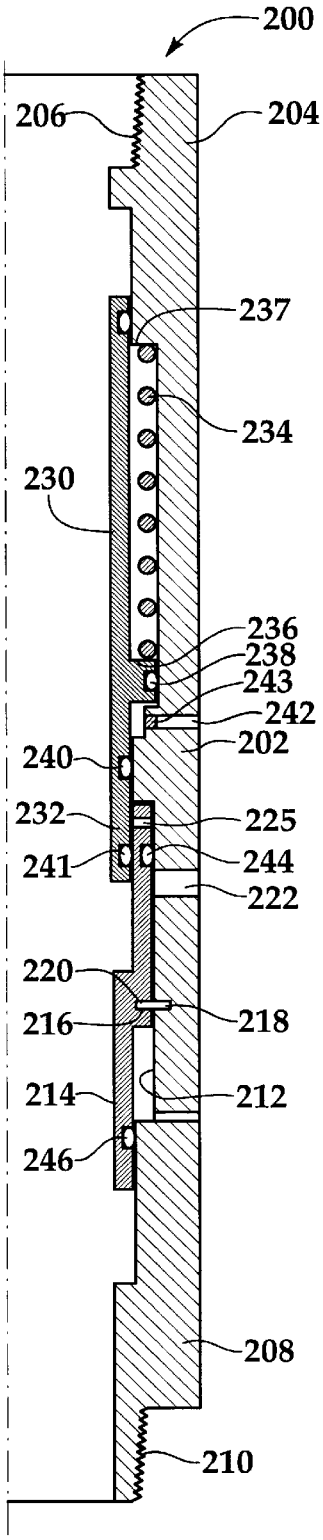
FIGS. 3A–3C are quarter sectional views of an internal pressure operated circulating valve of the present invention in its various operating positions.
Figure 3B:
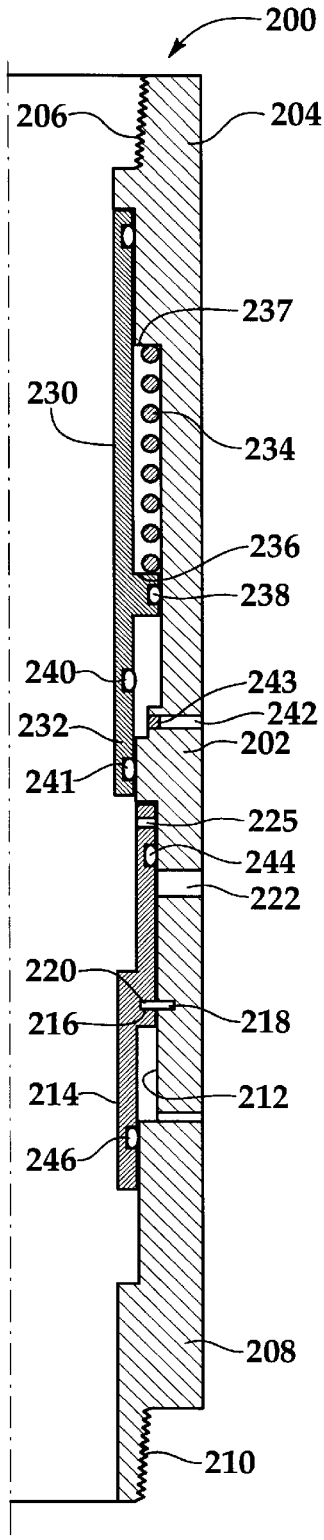
Figure 3C:
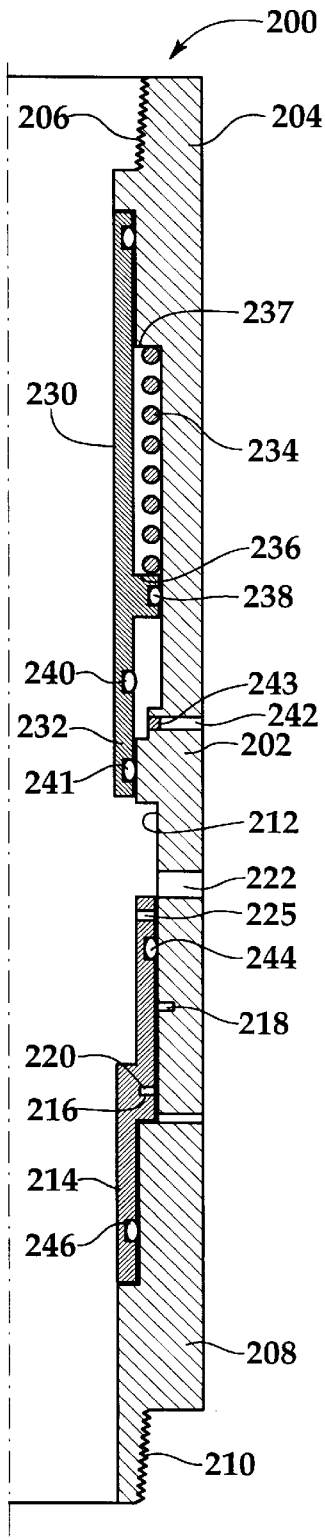

Referring now to FIGS. 3A–3C therein is depicted quarter sectional views of another embodiment of an internal pressure operated circulating valve of the present invention that is generally designated 200. Valve 200 includes a cylindrical outer housing 202 having an upper housing adapter 204 which includes threads 206 for attaching valve 200 to the portion of test string 36 located above valve 200. At the lower end of housing 202 is a lower housing adapter 208 which includes an external threaded portion 210 for connection of valve 200 to that portion of test string 36 located below valve 200.

Slidably and sealably received within inner bore 212 of housing 202 is operating mandrel 214. Operating mandrel 214 is initially frangibly retained in its noncirculating position by one or more shearable members such as shear pin 216 which is disposed through a radial bore 218 of housing 202 and received within a radially extending bore 220 of operating mandrel 214. In the noncirculating position as depicted in FIG. 3A, operating mandrel 214 prevents the flow of fluids between the exterior of valve 200 and the interior of valve 200 through circulating port 222. Operating mandrel 214 includes a communication port 225.

Slidably and sealably received within inner bore 212 of housing 202 above operating mandrel 214 is safety mandrel 230. Safety mandrel 230 includes a lower end 232 that is closely received within operating mandrel 214 to prevent internal pressure from entering communication port 225 thereby preventing the movement of operating mandrel 214.

A coil compression spring 234 has its upper end engaging the lower shoulder 237 of housing 202 and has its lower end engaging annular upper end surface 236 of safety mandrel 230. Spring 234 biases safety mandrel 230 downwardly to maintain lower end 232 within operating mandrel 214 and prevent movement of operating mandrel 214. In this position of valve 200, internal pressure testing of testing string 36 may periodically occur without moving operating mandrel 214 or loading shearable member 216.

Spring 234 is initially retained in a substantially uncompressed state until external hydrostatic pressure acting between seals 238 and 240 through communication port 242 of housing 202 reaches a predetermined level. When the external hydrostatic pressure reaches a sufficient level, safety mandrel 230 travels upwardly relative to housing 202 compressing spring 234, as best seen in FIG. 3B. A rupture disk 243 may be placed within communication port 242 to selectively prevent the external hydrostatic pressure from communicating to safety mandrel 230 until the external hydrostatic pressure reaches a sufficient level to burst rupture disk 243. Once safety mandrel 230 has traveled upwardly, seal 241 no loner prevents internal pressure from entering communication port 225. If the external hydrostatic pressure is reduced below the predetermined level, however, valve 200 will reset into the position depicted in FIG. 3A due to the bias force of spring 234. This procedure may be repeated without moving operating mandrel 214.

When valve 200 is in the position depicted in FIG. 3B, application of internal pressure acts on operating mandrel 214 between seals 244 and 246 thus urging operating mandrel 214 downwardly. When sufficient pressure is applied, pins 216 shear thus permitting operating mandrel 214 to move downwardly, as best seen in FIG. 3C.

In operation, valve 200 is initially assembled at the surface as shown in FIG. 3A. Thereafter, valve 200 is incorporated into test string 36 as shown in FIG. 1 and lowered into wellbore 18. After testing and treatment, but prior to raising test string 36 out of wellbore 18, it is desirable to reverse circulate fluids from test string 36 which may shift safety mandrel 230 but will not shift operating mandrel 114 at valve 200. Such is accomplished by moving operating mandrel 214 downwardly so that circulation port 222 is in communication with the interior of housing 202. Thereafter, fluid is pumped downwardly in the annulus through port 222 and upwardly through test string 36 thereby circulating well fluids from test string 36.

Valve 200 is opened by shifting safety mandrel 230 then shifting operating mandrel 214 as follows. With valve 200 in the configuration of FIG. 3A and suspended on test string 36 as shown in FIG. 1, the hydrostatic pressure of the annulus fluids upwardly bias safety mandrel 230 via communication port 242. Seal 238 defines an outer diameter and seal 240 an inner diameter of safety mandrel 230. When the hydrostatic force reaches the predetermined level necessary to overcome the bias force of spring 234, safety mandrel 230 moves upwardly with lower end 232 and seal 241 of safety mandrel 230 no longer contacting operating mandrel 214. A rupture disk 243 may additionally be placed within communication port 242 that is set to burst at a predetermined pressure.

After safety mandrel 230 has moved to its upper position as best seen in FIG. 3B, test string 36 is pressurized thus permitting pressurized fluid to travel through communication port 225 and act on operating mandrel 214. Seal 244 defines an outer diameter and seal 246 defines the inner diameter of operating mandrel 214. When the pressure reaches the predetermined level necessary to shear the shear pins 216, operating mandrel 214 moves quickly downwardly.

In the lower position of operating mandrel 214 as best seen in FIG. 3C, seal 244 is below port 222 and thus fluid communication is permitted between the annulus and the interior of housing 202 thereby allowing reverse circulation.

Thus, it can be seen that prior to operating of safety mandrel 230 there is no risk of inadvertently opening circulation port 222 since interior pressure will not operate operating mandrel 214. Before pressure in test string 36 can be so communicated, safety mandrel 230 must be urged upwardly until seal 241 is above communication port 225 of operating mandrel 214.

Once operating mandrel 214 has opened circulating port 222, it remains open. When the formation fluids are circulated out of test string 36 and fully replaced by the fluids from the annulus, test string 36 may be pulled from wellbore 18.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is therefore, intended that the appended claims encompass any such modifications or embodiments.

What is claimed is:

1. A downhole tool comprising:

a housing;

a safety mandrel slidably received within the housing, the safety mandrel operating in a first direction between a first position and a second position relative to the housing in response to pressure being applied to the exterior of the housing; and an operating mandrel slidably received within the housing, the operating mandrel operating in a second direction from a first position to a second position relative to the housing in response to pressure being applied to the interior of the housing when the safety mandrel is in the second position of the safety mandrel relative to the housing.

2. The downhole tool as recited in claim 1 wherein a portion of the safety mandrel is slidably received within the operating mandrel when the safety mandrel is in the first position of the safety mandrel it selectively prevent the operation of the operating mandrel.

3. The downhole tool as recited in claim 2 wherein the safety mandrel prevents the operation of the operating mandrel by physically preventing the movement of the operating mandrel in the second direction.

4. The downhole tool as recited in claim 2 wherein the safety mandrel prevents the operation of the operating mandrel by preventing the pressure applied to the interior of the housing from acting on the operating mandrel.

5. The downhole tool as recited in claim 1 further comprising a biasing device urging the safety mandrel in the second direction such that a predetermined pressure applied to the exterior of the housing is required to operate the safety mandrel to the second position.

6. The downhole tool as recited in claim 1 further comprising a frangible restraining device selectively preventing movement of the operating mandrel such that a predetermined pressure applied to the interior of the housing is required to operate the operating mandrel to the second position.

7. The downhole tool as recited in claim 1 wherein the operating mandrel permits fluid flow through a circulating port formed through a wall in the housing when the operating mandrel operates to the second position.

8. A circulating valve comprising:

a housing having a circulating port formed therethrough;

a safety mandrel slidably received within the housing, the safety mandrel reversibly moveable from a first position to a second position in response to a predetermined level of external pressure being applied to the exterior of the housing and reversibly moveable from the second position to the first position when the pressure being applied to the exterior of the housing is decreased below the predetermined level; and an operating mandrel slidably received within the housing, the operating mandrel having a noncirculating position wherein fluid flow through the circulating port is prevented and a circulating position wherein fluid flow through the circulating port is permitted, the operating mandrel operating from the noncirculating position to the circulating position in response to a predetermined level of internal pressure being applied to the interior of the housing while the predetermined level of external pressure maintains the safety mandrel in the second position.

9. The circulating valve as recited in claim 8 wherein a portion of the safety mandrel is slidably received within the operating mandrel when the safety mandrel is in the first position of the safety mandrel to selectively prevent the movement of the operating mandrel from the noncirculating position to the circulating position.

10. The circulating valve as recited in claim 9 wherein the safety mandrel prevents the movement of the operating mandrel from the noncirculating position to the circulating position by preventing the pressure applied to the interior of the housing from acting on the operating mandrel.

11. The circulating valve as recited in claim 9 wherein the safety mandrel prevents the movement of the operating mandrel from the noncirculating position to the circulating position by physically retaining the operating mandrel in the noncirculating position.

12. The circulating valve as recited in claim 8 further comprising a biasing device urging the safety mandrel toward the first position such that a predetermined pressure applied to the exterior of the housing is required to operate the safety mandrel from the first position to the second position.

13. The circulating valve as recited in claim 8 further comprising a frangible restraining device selectively preventing movement of the operating mandrel such that a predetermined pressure applied to the interior of the housing is required to operate the operating mandrel from the noncirculating position to the circulating position.

14. A method for operating an operating mandrel disposed within a housing of a downhole tool comprising the steps of:

disposing a safety mandrel in the housing to selectively prevent the operation of the operating mandrel;

applying pressure to the exterior of the housing to operate the safety mandrel in a first direction between a first position and a second position relative to the housing; and applying pressure to the interior of the housing to operate the operating mandrel in a second direction relative to the housing from a noncirculating position to a circulating position when the safety mandrel is in the second position.

15. The method as recited in claim 14 wherein the step of disposing a safety mandrel in the housing to selectively prevent the operation of the operating mandrel further comprises disposing a portion of the safety mandrel within the operating mandrel when the safety mandrel is in the first position of the safety mandrel to prevent the operation of the operating mandrel.

16. The method as recited in claim 15 wherein the step of disposing a portion of the safety mandrel within the operating mandrel to selectively prevent the operation of the operating mandrel further comprises preventing the pressure applied to the interior of the housing from acting on the operating mandrel.

17. The method as recited in claim 15 wherein the step of disposing a portion of the safety mandrel within the operating mandrel to initially prevent the operation of the operating mandrel further comprises physically preventing the movement of the operating mandrel in the second direction.

18. The method as recited in claim 14 further comprising the step of biasing the safety mandrel in the second direction such that a predetermined pressure applied to the exterior of the housing is required to operate the safety mandrel to the second position.

19. The method as recited in claim 14 further comprising the step of frangibly restraining the operating mandrel such that a predetermined pressure applied to the interior of the housing is required to operate the operating mandrel to the circulating position.

20. The method as recited in claim 14 wherein the step of applying pressure to the interior of the housing to operate the operating mandrel in the second direction from the noncirculating position to the circulating position further comprises permitting fluid flow through a circulating port formed through a wall in the housing.

* * * * *